US006166311A

United States Patent [19]

Barrickman

[11] Patent Number: 6,166,311

[45] Date of Patent: Dec. 26, 2000

[54] DRUM HOOP WITH PROTECTIVE EDGE

[76] Inventor: Rick Barrickman, 2509 Sharon Cir., Louisville, Ky. 40218

[21] Appl. No.: 09/349,854

[22] Filed: Jul. 8, 1999

Related U.S. Application Data

[60] Provisional application No. 60/092,060, Jul. 8, 1998.

[51] Int. Cl.[7] ..... G10D 13/02

[52] U.S. Cl. ..... 84/411 R; 84/413; 84/411 A

[58] Field of Search ..... 84/411 R, 413, 84/419, 411 A

[56] References Cited

U.S. PATENT DOCUMENTS

| | | | |
|---|---|---|---|
| 350,870 | 10/1886 | Cubley | 84/411 R |
| 360,534 | 4/1887 | Lyon . | |
| 3,421,400 | 1/1969 | Yokoi . | |
| 3,818,791 | 6/1974 | Zickos . | |
| 4,079,657 | 3/1978 | Sobreira . | |
| 4,334,458 | 6/1982 | Grauso . | |
| 4,714,002 | 12/1987 | Cleland | 84/413 |
| 4,869,146 | 9/1989 | Bonsor . | |
| 4,903,569 | 2/1990 | Kurosaki . | |
| 4,970,933 | 11/1990 | Hsieh . | |
| 5,025,697 | 6/1991 | May . | |
| 5,208,412 | 5/1993 | Hoshino . | |
| 5,261,309 | 11/1993 | Valen | 84/453 |
| 5,377,576 | 1/1995 | Good et al. . | |
| 5,410,938 | 5/1995 | Kurosaki . | |
| 5,546,841 | 8/1996 | Chen . | |
| 5,587,544 | 12/1996 | Fujii et al. | 84/411 R |
| 5,606,142 | 2/1997 | Volpp . | |
| 5,675,099 | 10/1997 | Granatello . | |

FOREIGN PATENT DOCUMENTS

| | | |
|---|---|---|
| 3503866 | 10/1985 | Germany . |

*Primary Examiner*—Jeffrey Donels
*Assistant Examiner*—Shih-Yung Hsieh
*Attorney, Agent, or Firm*—Jeffrey A. Haeberlin; Middleton & Reutlinger

[57] ABSTRACT

A drum hoop assembly wherein the annular drum hoop has an inwardly directed edge which partially or substantially covers the bearing edge of the drum shell. The inwardly directed edge protects the bearing edge of the drum shell such that contact with a drum stick or damage is prevented. The drum hoop provides sufficient coverage of the bearing edge to prevent accidental damage from occurring and also provides proper tensioning of the drum head on the drum shell.

13 Claims, 2 Drawing Sheets

DRUM HOOP WITH PROTECTIVE EDGE

CROSS-REFERENCE TO RELATED APPLICATIONS

This application claims the benefit of U.S. Provisional Application Ser. No. 60/092,060, filed Jul. 8, 1998.

BACKGROUND OF THE INVENTION

1. Field of the Invention

The present invention relates to a drum hoop and more particularly to a drum hoop having a protective rim or edge.

2. Description of the Prior Art

Drum assemblies come in various designs. The typical assembly of a drum includes: a cylindrical and hollow drum shell; a drum head, which is comprised of a film attached to a rim, which lays over the end of the drum shell and which acts as the acoustic resonator; drum hoops which act to securely compress the acoustic resonator or film against the bearing edge of the drum shell; and rings or other hardware which are used to clamp the hoops to the exterior of the drum shell. The drum hoops are circular in design and specifically act to tension the film down against the bearing edge of the drum shell. In order to properly clamp the drum head to the drum shell, the drum hoops are made of a very strong material, typically steel.

Many alternative designs or additives to steel drum hoops have been proposed and are designed to prevent damage to the drum stick. Additionally, other types of steel drum hoops are known which seek to enhance the acoustic response of the film or which seek to ease the assembly of the drum itself. None of the prior arts steel drum hoops seek to affirmatively protect the bearing edge of the drum shell when in use. The drum shell may be made of wood and can be easily damaged through a drum stick hitting the bearing edge, mis-assembly of the film and drum hoop assembly, or through wear and tear which normal drum shells undergo. This damage, however, may be minimized by seeking to protect the top most bearing edge of the drum shell which is directly adjacent to placement of the drum hoop and over which the drum film lies. It is requisite that a good airtight seal between the drum film and the bearing edge of the drum shell occur in order to enhance the resonance of the drum itself. If the bearing edge of the drum shell is damaged in some way, for example, through a drum stick hitting the bearing edge, this airtight seal can be damaged and as a result the sound which the drum produces can be significantly changed.

Most prior art steel drum hoops compress the drum film against the bearing edge of the drum shell and have an upwardly and outwardly extending annular rim. The steel drum hoops of the prior art do not seek to protect the bearing edge of the drum shell and only seek to maximize the impression of the drum film onto the drum shell or to ease assembly or protect the other aspects of the drum assembly.

U.S. Pat. No. 5,261,309 is directed towards a drum stick wear pad assembly which attaches to the drum hoop along an arch where the handle of the drum stick meets the drum hoop. This drum stick wear pad merely covers only a small portion of the drum hoop and clamps down over the top of a small portion thereof. This patent discusses the possibility of the wear pad extending over the drum rim partially or substantially about or along the rim, merely serving to protect the rim. The pad does not extend inwardly from the arcuate rim over the bearing edge of the drum shell. U.S. Pat. No. 3,421,400 teaches a drum and drum head construction wherein the drum sheet is attached to the drum by clamping means which incorporates a belt and tensioning ring. However, the tensioning ring is utilized merely to apply pressure to the drum head sheet along the crown of the drum head sheet, but does not provide protection to the drum shell or bearing edge.

SUMMARY OF THE INVENTION

The drum hoop of the present invention proposes to correct the deficiencies of the prior art drum assemblies by providing an inwardly directed edge to cover the bearing edge of the drum shell. In most instances, the bearing edge of the drum shell is left exposed to damage by the drum stick or other means. The drum hoop of the present invention has an inwardly directed edge which partially or substantially covers the top most bearing edge of the drum shell through the use of a rim which is beveled or which slightly tapers at its inner most point. The drum hoop of the present invention serves to prevent damage to the bearing edge while also tensioning the drum head to the drum shell.

An object of the present invention is to therefore to provide a protective apparatus for the bearing edge of the drum shell. A further object of the present invention is to provide a drum hoop which adequately tensions the drum head to the drum shell while also providing a protective inwardly directed edge over the bearing edge. An even further object of the present invention is to provide an inwardly directed protective edge of the drum hoop to cover the bearing edge such that the bearing edge of the drum shell does not come into contact with a drum stick thereby preventing damage to the bearing edge of the drum shell. It is even a further object of the present invention it that the drum hoop not affect the sound characteristics of the drum. These and other objects of the present invention are solved by the design of the drum hoop described herein.

BRIEF DESCRIPTION OF THE DRAWINGS

A better understanding of the invention will be had upon reference to the following description in conjunction with the accompanying drawings in which like numerals refer to like arts and wherein.

DETAILED DESCRIPTION OF THE PREFERRED EMBODIMENT

Figure 1:
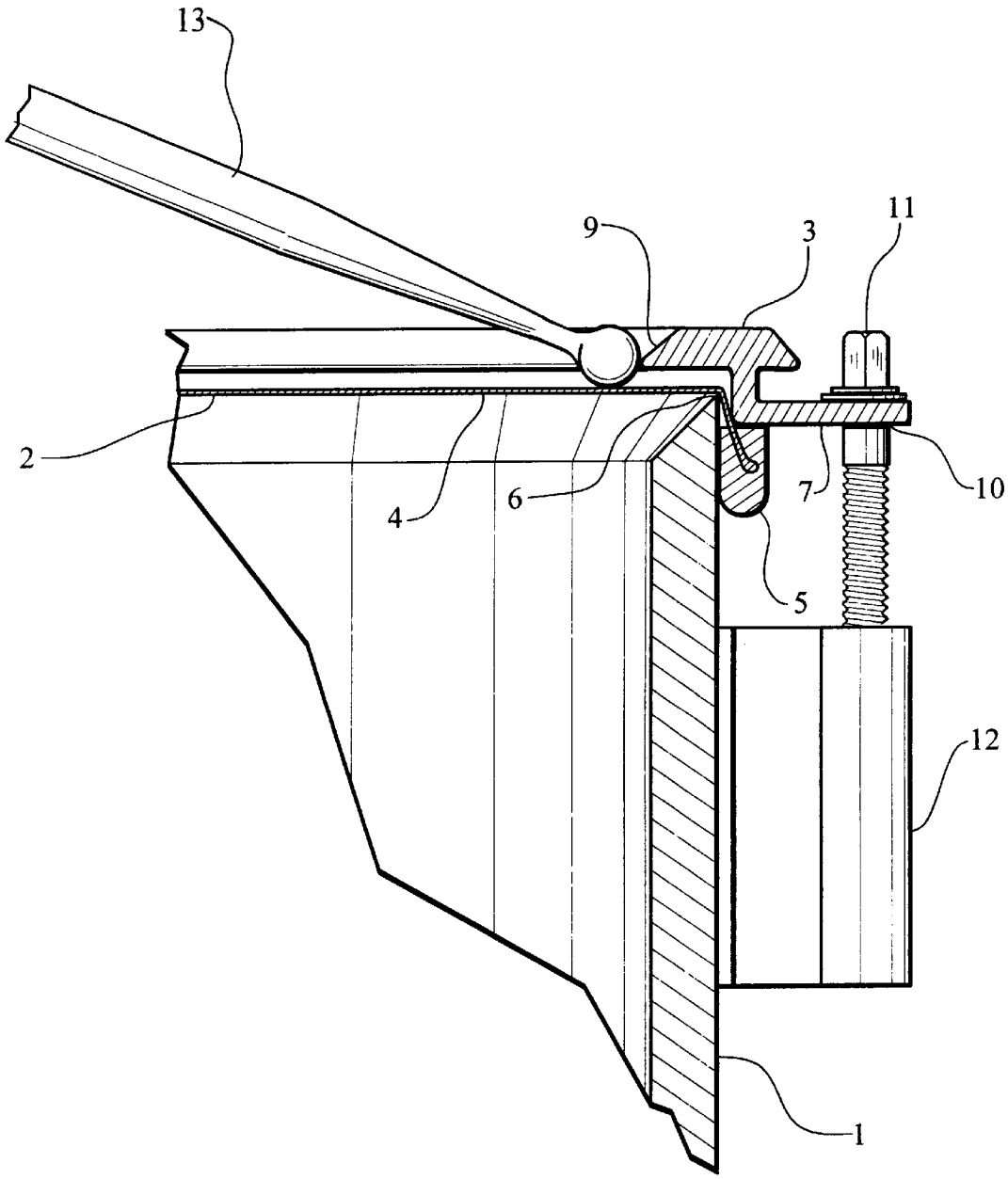
FIG. 1 is a partial side sectional view of a fully constructed drum including a drum hoop of the present invention.
Figure 3:
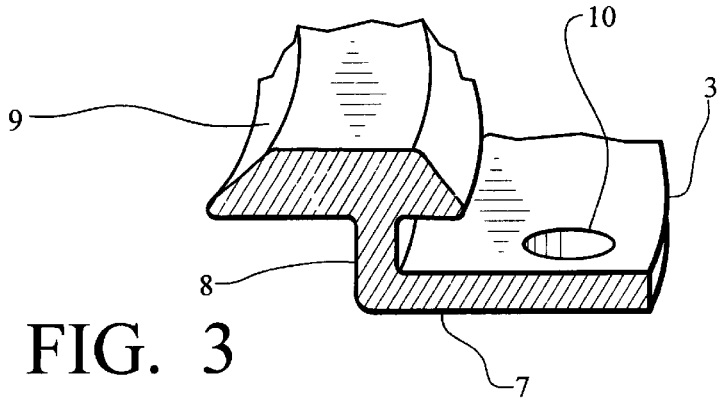
FIG. 3 is a perspective sectional view of the drum hoop of the present invention.

As shown in FIGS. 1 and 3, the drum is constructed of a drum shell 1, drum head 2, and drum hoop 3. The drum shell 1 is cylindrical in shape and has an open top end.

FIG. 1 shows that the drum head 2 is placed over the open top end of the drum shell 1, drum head 2 including a film 4 which is captured along its outer periphery with a rim member 5.

As further shown in FIG. 1, the topmost surface of the drum shell 1 includes the bearing edge 6. The bearing edge 6 is angled downwardly, slightly, such that it makes a singular and annular contact point for the drum head 2. The drum head 2 is overlaid on the open end of the drum shell 1 such that the outer periphery of the drum head 2 overlays the annular rim of the bearing edge 6. In order to provide adequate tensioning of the drum head on the drum shell 1, a drum hoop 3 is provided to clamp the drum head 2 against the drum shell 1.

As shown in FIGS. 1 and 3, drum hoop 3 is provided with a base element 7 which has an upwardly extending neck 8 and an annular protective edge 9 extending inwardly from the neck 8. The base element 7 is also provided with bolt receiving apertures 10 spaced around its outer periphery.

Figure 2:
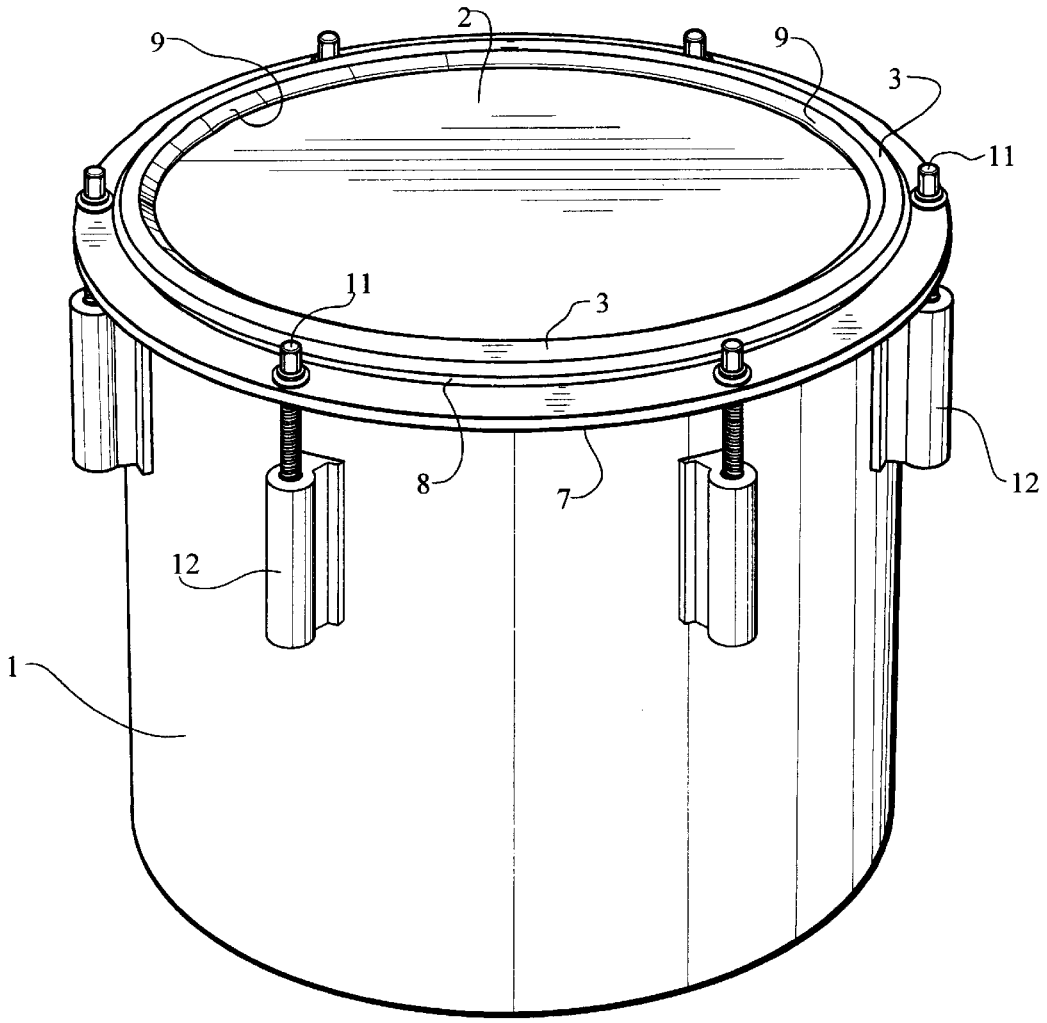
FIG. 2 is a perspective view of the fully constructed drum including the drum hoop of the present invention.

FIGS. 1 and 2 show a means for tightening or loosening the drum head 2 and thereby increasing or decreasing the tension on drum head 2 by the use of adjusting bolts 11 which extend through the bolt receiving apertures 10 on the drum hoop 3. In co-operative relation with threaded bolt receiving blocks 12 attached around the outer periphery of the drum shell 1 in alignment with the bolt receiving apertures 10, bolts 11, upon clockwise or counter-clockwise movement, increase or decrease tension on the drum head 2.

As shown in FIG. 1, the annular protective edge 9 of the drum hoop 3 extends over the bearing edge 6 of the drum shell 1. This protective edge 9 prevents a drum stick 13 from coming into contact with the drum head 2 directly over the bearing edge 6 that is, the vertical distance between the bottom of the protective edge 9, which extends inwardly from the top of the neck 8, and the plane of the drum head 2 is less than the diameter of a drum stick 13 tip. As a result, damage will occur to the drum stick 13 and not to the bearing edge 6 should the drummer mistakenly hit the drum hoop 3 or area adjacent to the bearing edge 6 as opposed to the drum head 2.

In order to decrease the damage to the drum stick 13 should it come into contact with the protective edge 9, the protective edge 9 may be slightly beveled or may merely taper downward as it comes to its inner most point. Whichever design is proposed, it must be sufficient to protect the bearing edge 6 of the drum shell 1 and also reduce damaging of the drum stick 13 should contact occur.

The drum hoop 3 of the present invention may be made of steel or other metal and may be machined to a smooth finish as is typical in these designs. The drum shell 1 is preferably constructed of wood or other material.

Various changes may be made to the form, construction, or arrangement of the afore-described embodiment without departing from the spirit and scope of the present invention as set forth in the following claims.

The invention claimed is:

1. A unitary drum hoop for attaching a drum head to a drum shell comprising:

a) an annular, laterally extending base element;

b) a neck extending upwardly from said base element such that the vertical distance from the top of the neck to the plane of the drum head is less than the diameter of a drum stick tip; and c) an annular protective edge extending inwardly from said neck a sufficient distance to cover a bearing edge of the drum shell.

2. The hoop of claim 1 wherein said protective edge is located on an inner periphery of said neck.

3. The hoop of claim 1 wherein said protective edge is beveled.

4. The hoop of claim 1 wherein said protective edge tapers downward to its inner-most point.

5. The hoop of claim 1 wherein said hoop is metal.

6. The hoop of claim 5 wherein said metal is steel.

7. The hoop of claim 1 wherein said outer periphery of said base has a plurality of bolt receiving apertures spaced there around.

8. A drum assembly comprising:

a) a drum shell having an open top and a bearing edge surrounding said open top;

b) a drum head having a film attached to a rim circumferentially extending around said shell, said drum head being placed over said open top of said drum shell such that said film contacts said bearing edge;

c) a drum hoop having an annular, laterally extending base element, a neck extending upwardly from said base element such that the vertical distance from the top of the neck to the plane of the drum head is less than the diameter of a drum stick tip; and an annular protective edge extending inwardly from said neck a sufficient distance to cover the bearing edge of the drum shell; said hoop being placed over said drum head and said drum shell such that said base element contacts said rim of said drum head; and, d) a means for clamping said drum hoop to said drum shell.

9. The drum assembly of claim 8 wherein said protective edge is located on said inner periphery of said neck.

10. The drum assembly of claim 8 wherein said protective edge is beveled.

11. The drum assembly of claim 8 wherein said protective edge tapers downward to its inner most point.

12. The drum assembly of claim 8 wherein said hoop is metal.

13. The drum assembly of claim 12 wherein said metal is steel.

* * * * *